US006224512B1

(12) United States Patent
Arnesson

(10) Patent No.: US 6,224,512 B1
(45) Date of Patent: May 1, 2001

(54) TEST AND TRAINING DEVICE AND METHOD

(76) Inventor: Ulf Arnesson, Oxeltunet 6, S-18148 Lidingo (SE)

( * ) Notice: Subject to any disclaimer, the term of this patent is extended or adjusted under 35 U.S.C. 154(b) by 0 days.

(21) Appl. No.: 09/202,555

(22) PCT Filed: Jun. 26, 1997

(86) PCT No.: PCT/SE97/01155

§ 371 Date: Dec. 18, 1998

§ 102(e) Date: Dec. 18, 1998

(87) PCT Pub. No.: WO97/49459

PCT Pub. Date: Dec. 31, 1997

(30) Foreign Application Priority Data

Jun. 27, 1996 (SE) ..... 9602557

(51) Int. Cl.[7] ..... A63B 21/00
(52) U.S. Cl. ..... 482/5; 482/8; 482/900
(58) Field of Search ..... 482/1–9, 900–902; 434/247

(56) References Cited

U.S. PATENT DOCUMENTS 5,407,403 * 4/1995 Coleman ..... 482/6
5,431,609 * 7/1995 Panagiotopoulos et al. ..... 482/9
5,827,154 * 10/1998 Gill ..... 482/9
5,989,166 * 11/1999 Capizzo et al. ..... 482/1

* cited by examiner

*Primary Examiner*—Glenn E. Richman
(74) *Attorney, Agent, or Firm*—Rockey, Milnamow & Katz, Ltd.

(57) ABSTRACT

A testing and training appliance and a method of testing and/or training with a testing and training appliance that includes a loading device (5), a stand (2, 3) adapted to accommodate the loading device (5), a maneuvering arrangement (11, 12, 13) connected to the loading device (5), a connecting element (6, 7) disposed between the loading device (5) and the maneuvering arrangement (11, 12, 13), and a controlling and regulating unit (14) adapted for testing and/or training purposes. The loading device (5) can be regulated between an upper position and a lower position with the aid of the maneuvering arrangement (11, 12, 13) and the connecting element (6; 7) of said loading device. The test object is registered and settings relating to load, number of measurements, and the starting and turning position of the loading device are implemented, wherewith the loading device (5) is regulated in accordance with a given movement pattern between the starting position and stop position subsequent to starting the appliance.

11 Claims, 2 Drawing Sheets

TEST AND TRAINING DEVICE AND METHOD

CROSS-REFERENCE TO RELATED APPLICATIONS

This application is an application filed under 35 U.S.C. Sec. 371 as a national stage of international application PCT/SE97/01155, which was filed Jun. 26, 1997.

FIELD OF INVENTION

The present invention relates to a testing and training device intended primarily for testing and training knee and leg muscles and also for use in the rehabilitation of such muscle groups.

BACKGROUND ART

Eccentric training and its positive effects on quality and strength in respect of elite athletes has been known for many years. The possibilities of creating a reliable and relevant lifting appliance for training with eccentric loads have been discussed in athletic clinics. The person lifting an eccentric load is much stronger in the eccentric phase than in the concentric phase. A person capable of managing a lift of 160 kg from a knee-bent position can normally manage to retard the downward movement of a weight of 210–220 kg.

The problem with conventional barbel bars, i.e. bars to which disc-shaped weights can be attached at each end, is that the weight lifter is unable to add weights above 200 kg, since he/she is unable to manage such a heavy weight in an upward lift. A weight lifter is at his/her weakest at the turning point.

OBJECT OF THE INVENTION

The object of the present invention is to provide a training and testing appliance that will solve the problems associated with earlier testing and training appliances intended for knee and leg muscles. Studies have shown that persons who have earlier had problems with their knees during training with barbel bars can now train with heavier weights without difficulty when using the inventive appliance.

A further object is to enable a weight lifter to retard downward movement of the weights to the greatest possible extent and also to control the weights at the turning point, without being afraid that the bar will fall across the weight lifter.

A further object of the invention is to provide an appliance that can be used in the rehabilitation of patients suffering from different types of injury. The appliance can be adapted to suit many different types of training, for instance eccentric training, concentric training, bench presses, floor lifts, forward thrusts, etc.

DISCLOSURE OF THE INVENTION

The weight lifting part of the inventive appliance is based on an hydraulic system in the form of at least one hydraulic piston-cylinder device that functions to control a vertically movable load to a position and at a speed that are in accordance with a pre-determined movement plan. When supplemented with two precision scales as load indicator elements, and registering and calculating equipment, possibilities are also created for both training and measuring in a novel manner relevant to athletes and sportsmen.

An appliance constructed in accordance with the invention can also be built to customer size requirements, e.g. in respect of basket ball players. Concentric exercises can also be performed when the weight in the form of a barbel bar is on the way up. The weight may exceed the maximum weight that the weight lifter can manage with free weights by 20%, and even higher. The equipment can be dimensioned for a maximum load of 550 kg for instance.

The speed at which the load moves in accordance with the plan can be set to any value whatsoever, e.g. slow movement on the way down and fast movement on the way up, or vice versa. The plan may also include accelerating or retarding speeds.

Furthermore, the top position to which the load can be lifted, i.e. the lifting height, and the bottom limit position of the load, i.e. the turning point, can be set freely in different vertical positions.

The scales measure the right and left legs in accordance with staring so as to ascertain which of the legs is weakest, and to ascertain from a print-out diagram the braking effect of the object, e.g. the lifter.

All data relating to a lifter is saved until his/her next training session. The curves on respective diagrams can then be superimposed and compared, in order to establish improvements in the condition of the person concerned.

BRIEF DESCRIPTION OF THE DRAWINGS

The invention will now be described in more detail with reference to the accompanying drawings, in which reference signs have been included.

DETAILED DESCRIPTION OF THE INVENTION

Figure 1:
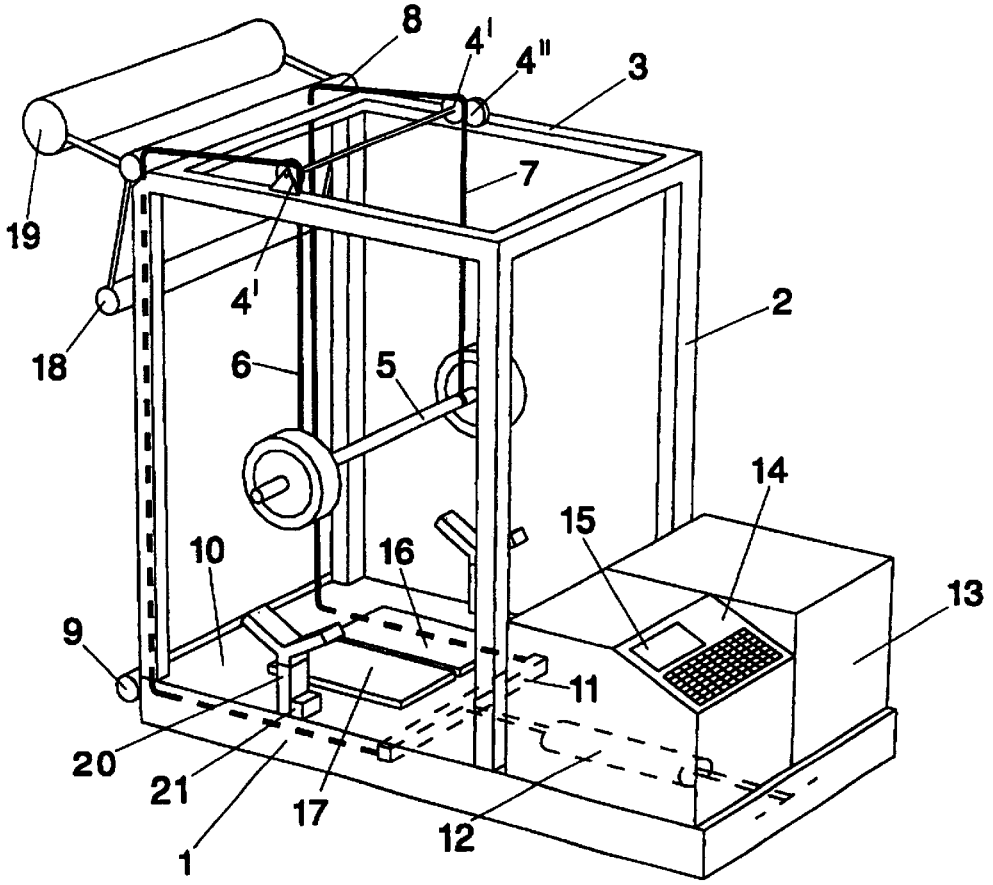
FIG. 1 is a schematic, perspective view of an inventive appliance.

FIG. 1 illustrates an appliance stand 2 mounted on a base 1. The stand 2 has preferably a box-like construction that includes an upper frame 3. Mounted on each of two opposing sides of the frame 3 is a line pulley 4'. The pulleys are connected to one side of a measuring device 4". Although the pulleys and measuring device can be combined in one and the same unit, they have been shown separated in the figure. Measuring devices may alternatively be provided on both sides of the frame, in connection with respective line pulleys on said sides.

A loading device 5, in the illustrated case a barbel bar, is suspended from two wires or cables, a right cable 6 and a left cable 7, at respective ends of the loading device/barbel bar. The cables 6, 7 run over the line pulleys at the measuring wheels 4 and generally horizontally and rearwardly over an upper line roller 8, which may alternatively be line pulleys, and then generally vertically downwards over a bottom line roller 9, which may alternatively be a line pulley, and from there generally horizontally forwards beneath a floor surface 10 to a maneuvering beam 11.

The maneuvering beam 11 is mounted on ball bearings and extends transversely between two horizontally mounted maneuvering rails. The maneuvering beam 11 can be displaced by means of one hydraulic piston-cylinder device 12 fixedly mounted to the base 1. The hydraulic piston-cylinder device 12 is maneuvered by a base-mounted hydraulic unit 13 which is controlled electrically by a control and regulator unit 14 to which presentation and registration devices 15 are connected. In this regard, presentation may take the form of a display or a print-out from a printer. Registration is effected by storing magnetic media for further processing and presentation. In an alternative embodiment, the loading device 5 may have the form of a bar to which no weights or the like are attached and which can be maneuvered directly with the aid of one or more hydraulic piston-cylinder devices in the absence of wires or cables.

The FIG. 1 embodiment also includes two load registering scales or load measuring devices 16, 17 which are mounted on the floor 10, one device 16 on the left and one device 17 on the right. These load measuring devices 16, 17 measure the load exerted by the object, i.e. the load exerted by the lifter, the long jumper, the slalom skier, and so on. In the illustrated case, the load measuring devices measure the load transferred thereto from the disc rod 5. The load is therewith divided into the force transmitted by the left leg and the force transmitted by the right leg. The load measuring devices 16, 17 are also connected to a load measuring devices electronic module which, in turn, may be connected to the presentation and recording devices 15 in the control and regulator unit 14. The illustrated embodiment also includes a wire tensioner 18 which keeps the wires 6, 7 tensioned through a lever-arm action and a weight 19. As will be evident from FIG. 1, the illustrated appliance also includes height-adjustable support devices 20 mounted on the floor 10, on respective sides of the load measuring devices 16, 17 beneath the loading device 5. Also included are optical devices 21 mounted at the foot of the support devices 20 and functioning to indicate that an object stands on the load measuring devices in readiness to be measured. The lifting action or retarding action can be interrupted at any time through the medium of these optical devices 21, by virtue of immediately interrupting said movement through the medium of photo cells.

Figure 2:
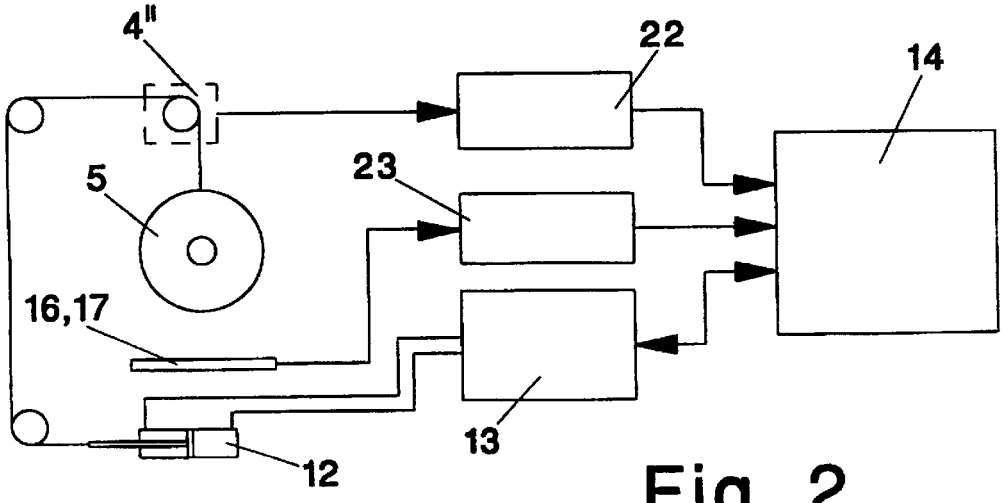
FIG. 2 is a diagrammatic illustration of the most relevant parts of the inventive appliance.

FIG. 2 is a diagrammatic illustration of the components described above, wherewith vertical movements of the loading device 5 are recorded directly as real values of the measuring device 4", these values being sent to an electronic measuring device 22 in which positional changes of the loading device 5 are converted to electric signals for further processing by the controlling and regulating unit 14. The signals are compared with set-point values in the controlling and regulating unit 14. When the recorded real values differ from the set-point values, the position of the loading device 5 is changed by actuation of the hydraulic unit 13, which adjusts, in turn, the state of the hydraulic piston-cylinder device 12. As will be evident from FIG. 2, the load measuring devices 16, 17 are connected electrically to an electronic load measuring device module 23. This module is adapted to calibrate and then register the load transferred from the loading device 5 of the object to the load measuring devices 16, 17. The module 23 is preferably comprised of an especially adapted weighing instrument provided with key pad and functions and tare with digit keys or tare with simple keying actions, showing gross, tare or net weight, adjustable closing-down, adjustable rest position, digitally adjustable filters, and an interface for computer connection, shown in the figure in connection with the controlling and regulating unit 14. When the controlling and regulating unit 14 is a computer, the electronic weighing module 23 may be comprised of a computer insertion card, in which case all functions of the module are obtained via the computer. As indicated by the double arrow in FIG. 2, the controlling and regulating unit 14 is monitored hydraulically.

Figure 3:
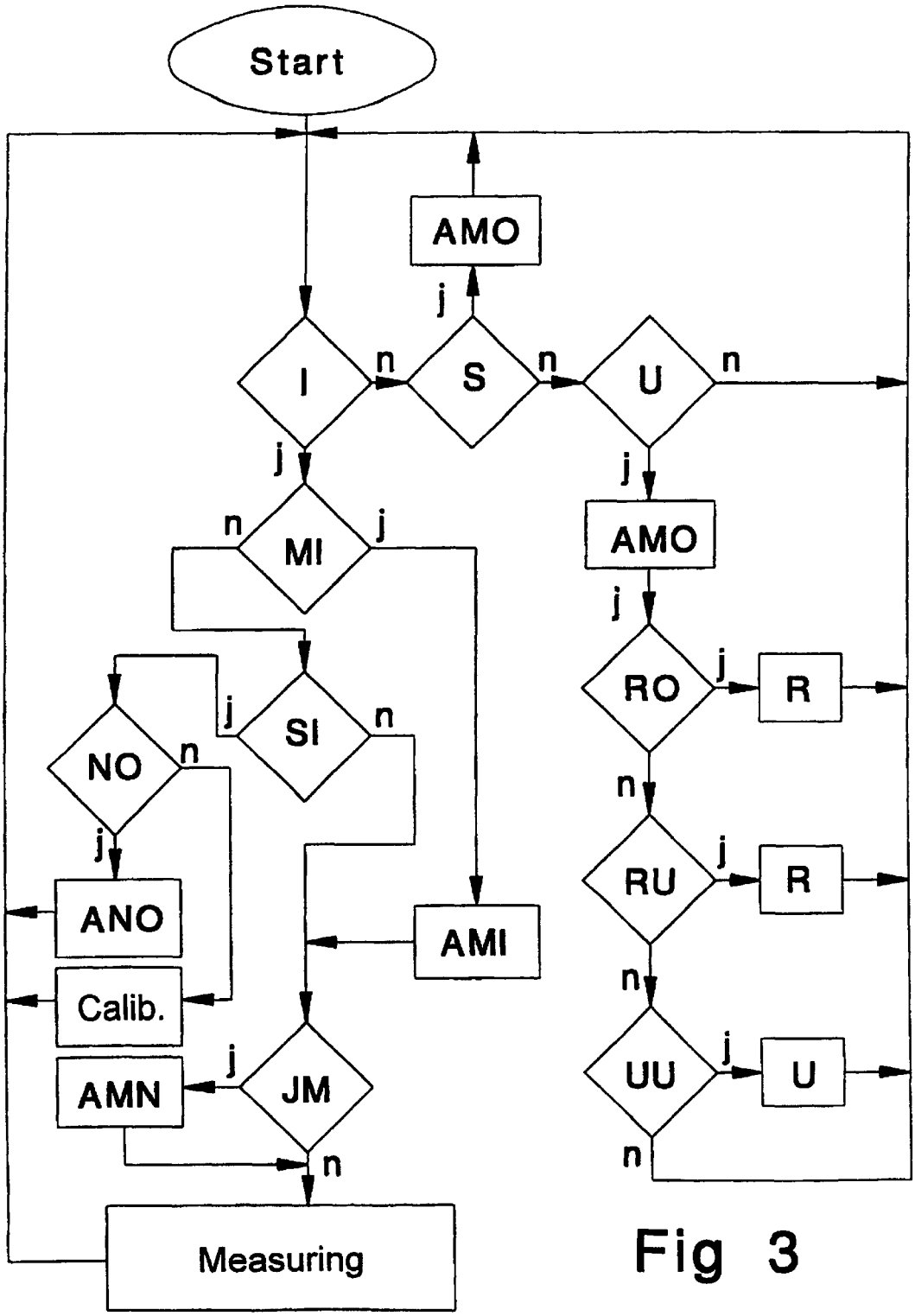
FIG. 3 is a flowsheet illustrating a method according to the invention.

FIG. 3 is a flow chart illustrating one embodiment of an inventive method which includes the following functions (selection facilities in the flow sheet are marked either yes (j) or no (n).

1. The height meter is calibrated after START, by choosing settings I on a menu presentation. System settings SI and Calibration are then chosen. In this regard, the loading device, for instance the barbel bar, is set to a known low level which is entered in a text box as height 1. The setting is verified with the OK-button. The loading device, e.g the barbel bar, is then set to a known high level, which is entered in a text box as height 2, and the setting verified with the OK- button. Enter "TERMINATE" and the calibration is ready.

2. Registration of new objects, for instance lifters, is made after START, by selecting settings I and system settings SI, and selecting new objects NO and entering new objects ANO, wherewith the following queries are presented:

| Type in: | Example: |
|---|---|
| Name (Christian and Surnames) | Sven Svensson |
| Sex: (M or F) | M |
| ID-number (6 digits) | 550910 |
| Weight (kg) | 95 |
| Length: (cm) | 193 |

3. Strength determination is carried out after START, by selecting strength determination S and then entering the object AMO by typing the name of the object in a name box or an identification number in an ID-box. Settings I and measurement settings MI are then selected. Measurement settings AMI are then entered by entering the load in kg and the number of measurements to be made, together with an entry that discloses starting height and turning point. The measuring process commences when the OK-button is pressed.

NB! If entry of the measurement settings AMI is terminated before the loading device is at the starting height that has been entered, or is above this height, the measuring process will commence immediately after"OK" is pressed.

The measuring process commences when the load comes beneath the height that was set as a starting point.

The object, e.g. the lifter, must then come beneath the turning point, or to a position equal to the turning point, or the turning point will not otherwise be registered. The measuring process then continues as though the object was on the way down. The measuring process is terminated when the object is again higher than the starting point or at a level equal therewith.

When more than one measuring process has been programmed, the button marked"NEXT MEASURING PROCESS" is pressed.

The computer program with which the method can be implemented clears the screen and a new measuring process is commenced when the barbel bar reaches a level beneath the starting point.

4. Print-outs are made after START, by selecting precisely print-outs U, whereafter the measuring object AMO is identified by typing the object's name in the name text box and/or the object's ID-number in an ID-number text box. All measuring processes that have been recorded are herewith shown in a list. A print-out selection UU of the measuring process or processes that shall be printed-out is then made, by selecting the row in which the number of the measuring process is given, whereafter a print-out U takes place. Several continuous measuring processes may be marked and printed-out (e.g. the last five measuring processes).

5. Measurements can be erased after START, by first selecting print-outs U and thereafter stating a measurement object AMO by typing the name in a name text box and/or the ID-number in an ID-number text box. All measurements that have been registered in respect of the measurement object are shown in accordance with the above. An erasion selection RU is then made for those measurements to be erased, by stating the row/rows in which the measurement number in question is given."MEASUREMENTS" is then indicated through the medium of a special button, whereafter erasion is effected by indicating"ERASE". All marked measurements are then immediately erased.

6. Object is erased RO in a similar manner, by first selecting print-outs U, whereafter measuring object AMO is indicated by typing the name in a name text box and/or the ID-number in an ID-number text box. All measurements that have been recorded in respect of the indicated measuring object will be shown."OBJECT" is then indicated through the medium of a special button, whereafter erasure R is effected by indicating"ERASE". When the question of whether an object shall be erased is answered in the affirmative "YES", the object is erased R and all measurements pertaining to the object and the object itself are erased from the personal register.

7. A comparison measurement is made after START, by selecting strength measurement S and thereafter indicating measurement object AMO by entering the name of the object in a name text box and/or the ID-number of the object in an ID-number text box. The settings I and measurement settings MI are then selected, whereafter measurement settings AMI are given, by entering a load in kg and the number of measuring processes to be carried out, and also an indication of starting height and turning point. A comparison measurement JM is then carried out, by entering the measurement number AMN, wherewith the possibility of repeating several comparisons is made available. Alternatively, a new measuring process can be started on top of the old measuring process. The measuring process commences when "OK" is pressed.

It will be understood that embodiments other than those described and illustrated are possible within the scope of the following claims. For instance, the load can be generated by a rigid device which is directly actuable by one or more hydraulic piston-cylinder devices.

What is claim is:

1. A testing and training device comprising a stand:

a loading device movably attached to said stand;

a maneuvering arrangement connected to said loading device by connecting elements;

a control unit connected to said maneuvering arrangement; and, at least one load measuring device connected to said control unit:

wherein said loading device moves between an adjustable upper position and an adjustable lower position:

and wherein said load measuring device registers the force or load transmitted by an object from said loading device and said control unit records said force or load;

and wherein said control unit controls said maneuvering arrangement which regulates movement of said loading device vertically between said adjustable upper position and said adjustable lower position through said connecting elements and wherein said control unit controls functions of said testing and training device selected from the group consisting of speed of upward movement of said loading device speed of downward movement of said loading device upper position of said loading device and lower position of said loading device.

2. The device of claim 1, wherein said maneuvering arrangement has at least one hydraulic piston-cylinder device.

3. The device of claim 2, wherein said maneuvering arrangement has a maneuvering beam connecting said hydraulic piston-cylinder device and said connecting elements.

4. The device of any one of claims 1, 2 and 3, wherein said loading device is a barbell, said barbell having a right end and a left end;

wherein said connecting elements are a right wire attached to said right end of said loading device and a left wire attached to said left end of said loading device.

5. The device of any one of claims 1, 2, 3, and 4 wherein said loading device moves in a selected pattern between said adjustable upper position and said adjustable lower position.

6. The device of claim 5, wherein said loading device is suspended from said right wire and said left wire and moves vertically between said adjustable upper position and said adjustable lower position.

7. The device of claim 1, having two load measuring devices, one for each leg, a left-hand device for the left leg and a right-hand device for the right leg, said devices functioning to register the force transmitted by an object from said loading device to each load measuring device.

8. A method of testing and/or training with said testing and training device of claim 1 comprising the steps of:

a) programming at least one of said functions of said control unit to a pre-selected value; and then, b) pressing against said loading device as it moves as programmed in step a) while the force or load transmitted by pressing against said loading device as it moves is measured by said load measuring device and recorded by said control unit as measured force or measured load.

9. The method of claim 8, wherein said measured force or measured load may be compared to a previous measured force or previous measured load from at least one prior testing and/or training session.

10. The method of claim 9, wherein said measured force or measured load is plotted as a curve against at least one previous measured force or previous measured load from at least one prior testing and/or training session.

11. The method of claim 9, wherein the difference between said measured force or measured load and at least one previous measured force or previous measured load from at least one prior testing and/or training session is plotted as a curve.

* * * * *